United States Patent [19]

Folding

[11] Patent Number: 4,932,811

[45] Date of Patent: Jun. 12, 1990

[54] WELL HEAD CONDUCTOR AND/OR CASISSON SUPPORT SYSTEM

[76] Inventor: Robert Folding, 212 Austin Rd., Youngsville, La. 70592

[21] Appl. No.: 363,066

[22] Filed: Jun. 8, 1989

[51] Int. Cl.[5] ..... E02D 5/00

[52] U.S. Cl. ..... 405/227; 405/195; 405/216

[58] Field of Search ..... 405/195, 211, 216, 224, 405/227, 249; 166/356, 359, 367

[56] References Cited

U.S. PATENT DOCUMENTS

| | | | |
|---|---|---|---|
| 2,651,181 | 9/1953 | Alcorn et al. | 405/227 X |
| 3,389,562 | 6/1968 | Mott et al. | 405/227 X |
| 4,118,942 | 10/1978 | Liautaud | 405/227 X |
| 4,561,802 | 12/1985 | Campo | 405/227 X |
| 4,679,964 | 7/1987 | Blandford | 405/224 X |
| 4,740,107 | 4/1988 | Casbarian et al. | 405/211 |

FOREIGN PATENT DOCUMENTS

| | | | |
|---|---|---|---|
| 8401934 | 1/1986 | Netherlands . | |
| 1013573A | 4/1983 | U.S.S.R. | 405/227 |
| 1563107 | 3/1980 | United Kingdom | 405/227 |
| 2153886 | 2/1984 | United Kingdom | 405/227 |

*Primary Examiner*—Dennis L. Taylor

*Assistant Examiner*—Arlen L. Olsen

*Attorney, Agent, or Firm*—Pravel, Gambrell, Hewitt, Kimball & Krieger

[57] ABSTRACT

What is provided is a system for supporting well production conductor and/or caisson which is extending above the water the line in an offshore setting, the system which includes a plurality of support clamps having a center located clamp portion for clamping around the exterior of the conductor and/or caisson, and four arm members radiating outwardly therefrom. Each of the arm members would support a piling clamp, each clamp having an opening therethrough for positioning on the sea bed; a second clamp is positioned around the conductor and/or caisson, at the level of the water, the configuration likewise having a plurality of arm members supporting a piling clamp on each end therefrom, the clamp members are aligned at the water level with the clamp members on the floor of the sea bed; introducing a piling through each of the piling clamps at the water level, and driving the piling through to each of the clamps on the floor of the sea bed to a depth so that the plurality of pilings, spaced apart and supported by the clamps support the conductor and/or caisson in the upright position against the lateral forces of the sea.

16 Claims, 10 Drawing Sheets

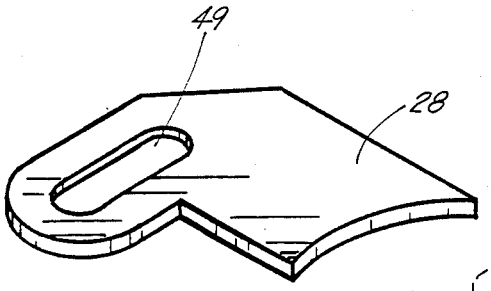
FIG. 11C
FIG. 7C
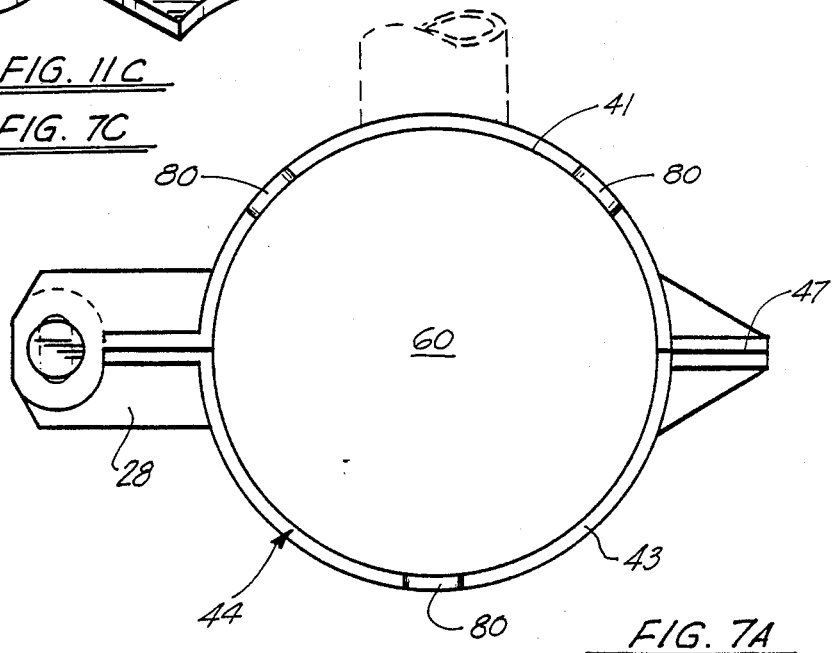
FIG. 7A
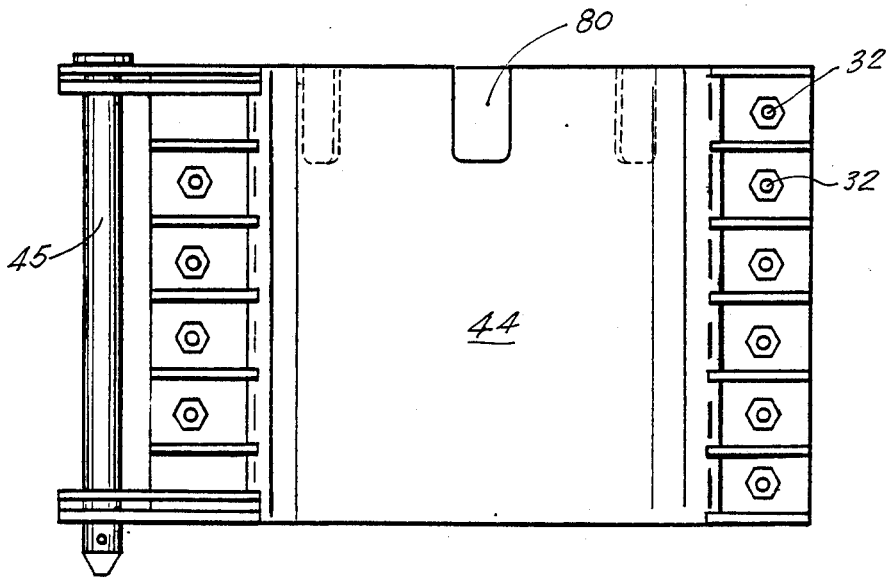
FIG. 7B

WELL HEAD CONDUCTOR AND/OR CAISSON SUPPORT SYSTEM

BACKGROUND OF THE INVENTION

1. Field of the Invention

The system of the present invention relates to oil and gas production. More particularly the present invention relates to a system for supporting a well head conductor and/or caisson extending from the surface of a body water, such as the Gulf of Mexico, in vertical relationship for withstanding wave action and the like in the body of water.

2. General Background

In offshore oil and gas production, a well head conductor would comprise a length of pipe that is driven around the drill line that protects the drill line. The drill line would carry the hydrocarbon product up to the well head or the "Christmas tree" for allowing the products to be diverted to vessels or to shore. The drill line is run inside the well conductor, which is driven over the drill line to protect it against the elements. The problem that is confronted is wave-action and other interferences such as boats or the like. The conductor must be secured because although the conductor is of sufficient size, it could be knocked over, or tipped with those various elements in it. Therefore, it must be protected and given some sort of support. Support may take the form of a caisson (a minimal support) or another support structure as in the past, and in deep water, normally what is provided is a four legged jacket with the legs extending outward at an angle in order to give it support so that production equipment can be placed on it. However, within the last five to ten years, operators of oil companies have moved away from expensive steel structures with a jacket and a deck, and have attempted to provide caisson installations for supporting the conductor pipe about the caissons. The problem to overcome, therefore, is placement of a support structure onto a single pipe such as a conductor and/or caisson extending out of the water, without damaging the structure or placing support on the conductor and/or caisson which should not be placed thereupon.

In the present state of the art, there is a system called the "Moss One System" which utilizes clamps clamped around the caisson which includes brackets which extend outward therefrom. At that point pilings are driven on a batter or a slight degree into the mud line and below the mud line at the bottom of the water. The structure is referred to as K-system structure in that it appears like an inverted K on both structures. The problem confronted in this type of structure, is that once it is installed there is only approximately 270° of accessibility to the caisson, due to the large pipe extending therefrom. If, therefore, a support deck is to be secured on the top of the structure, the support deck must clamp to the caisson and into the pilings that are projecting up to the water line. When this is done, the caisson becomes a third leg of the structure supporting a third of any of the forces that are being placed on it. Therefore it is strictly another clamp to the caisson. The system would also provide the unnecessary additional weight on the caisson.

An additional type of arrangement is entitled a "Sea Horse". The sea horse apparatus secures to the caisson by clamps and go from the mud line up above the water line. The clamp is bolted together so there is an enormous amount of diving time involved in the setting up of the system. The base of the sea horse clamp is approximately forty by forty feet square where piling are driven through the "cans" that are accessible into the mud line. The problem confronted is that a jack-up type vessel cannot get within twenty-five feet of the caisson without the vessel pads contacting the large structure sitting on the sea floor, and this arrangement causes in effect the requirement of a larger vessel so that lifting requirements can be met.

A third system which is utilized as a conductor anchoring system is a tension anchoring system. This particular system comprises clamp and a sheeve clamp. Piles are driven below the mud line, to secure a cable that it is attached to it through the shift clamp which allows movement up to the end clamp which is utilized to pull the tension on the cable. Once it is in place, there are three cables extending from the sea bed to ten feet below the water line which causes inaccessibility from jack-up type vessels coming in if they cannot see the sea lines underneath the water line. This is not a permanent structure, since it cannot take any significant weight since all of the weight would be going into the conductor and/or caisson.

There are several patents in the art which address offshore structures and the support of the those structures, the most pertinent being as follows:

| PATENT NO. | INVENTOR | TITLE |
|---|---|---|
| SU 1,013,573 | | "Jig For Constructing Pile Base" |
| 1,563,107 (U.K.) | Victor Sutton | "Piling" |
| 2,200,937 (U.K.) | Anton Coppens | "Offshore Tower Structure" |
| 3,389,562 | Mott et al. | "Salvageable Multi-Well Offshore Well Protector Platform" |
| 3,670,507 | Mott et al. | "Marine Drilling Structure With Curved Drill Conductor" |
| 3,991,581 | Kolb | "Method and Apparatus For Handling Piling And Anchoring An Offshore Tower" |
| 4,740,107 | Casbarian et al. | "Method And Apparatus For Protecting A Shallow-Water Well" |
| 4,793,739 | Hasle et al. | "Offshore Structure" |
| 8,401,934 (Netherlands) | Marcon Marine | "Structure-Supported Leg From Sea Bed" |

SUMMARY OF THE PRESENT INVENTION

The system and method of assembly of the present invention solves the problem of supporting an offshore well production conductor and/or caisson in a straightforward manner. What is provided is a system for supporting well production conductor and/or caisson which is extending above the water the line in an offshore setting, the system which includes a plurality support brackets having a center located clamp portion for clamping around the exterior of the conductor and/or caisson, and four arm members radiating outwardly therefrom. Each of the arm members would support a piling clamp, each having a bore therethrough for positioning on the sea bed; further a second clamp would be secured onto the caisson, at the level of the water, the second clamp likewise having a plurality of arm members supporting a piling clamp on each end therefrom. The clamp members at the water level would then be aligned with the clamp members on the floor of the sea bed; a piling would be introduced through each of the piling clamps at the water level, and the piling driven through to each of the clamps on the floor of the sea bed to a depth so that the plurality of pilings would be spaced apart and would support the conductor and/or caisson in the upright position against the lateral forces of the sea. There may be further provided means for providing a boat landing at the upper point of the pilings so that boats may approach the conductor and/or caisson, and work may be done on the production equipment positioned atop the conductor and/or caisson. There may be further provided means for extending the pilings above the height of the production equipment so that additional work decks may be added to the system to support equipment utilized with oil production offshore.

Therefore it is a principal object of the present invention to provide a system for supporting a conductor and/or caisson in the sea that would allow 360° access to the conductor and/or caisson during work on the associated components;

It is a further object of the present invention to provide a conductor and/or caisson support system offshore which would provide minimum interference with jack-up type vessels access to the conductor and/or caisson, and yet support the conductor and/or caisson against the lateral forces of the sea;

It is a further object of the present invention to provide a support system for a conductor and/or caisson, which would allow that any work decks or the like which must be built around the conductor and/or caisson would be supported by the support system and would not have to depend on the conductor and/or caisson for support;

It is a further object to provide a system for supporting conductor and/or caisson structure so that all of the weight of the structure is supported solely by the support system, with minimum stress on the conductor and/or caisson itself;

It is a further object of the present invention to provide a method for assembling the system of the present invention in order to obtain maximum efficient construction of the conductor and/or caisson support system.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIGS. 7A–7E represent views of the piling support clamp utilizing the support system of the present invention;

DETAILED DESCRIPTION OF THE PREFERRED EMBODIMENT

Figure 1:
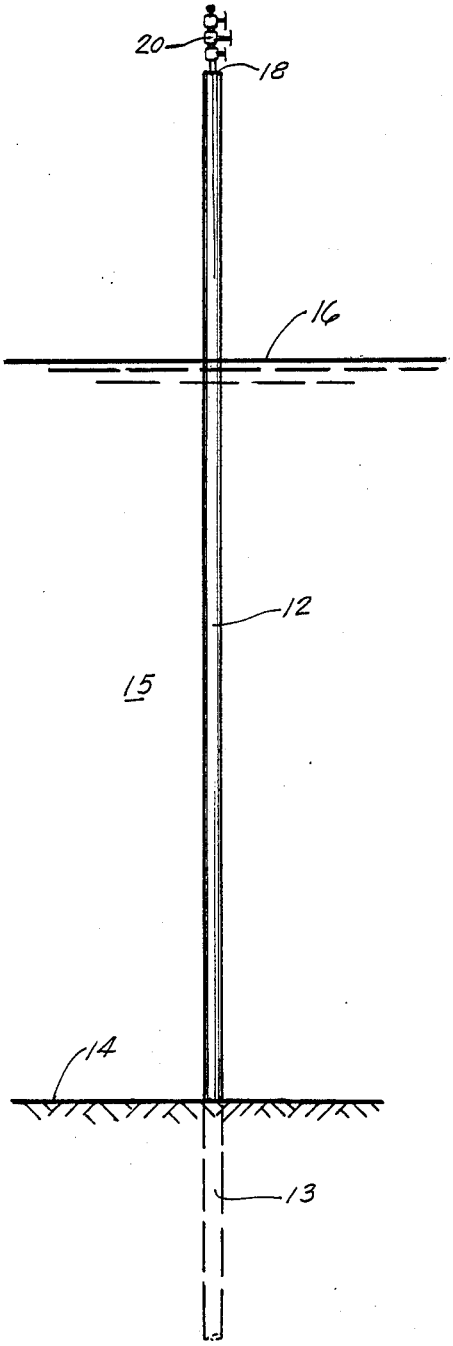
FIG. 1 illustrates a vertical conductor and/or caisson extending out from the sea unsupported.
Figure 8:
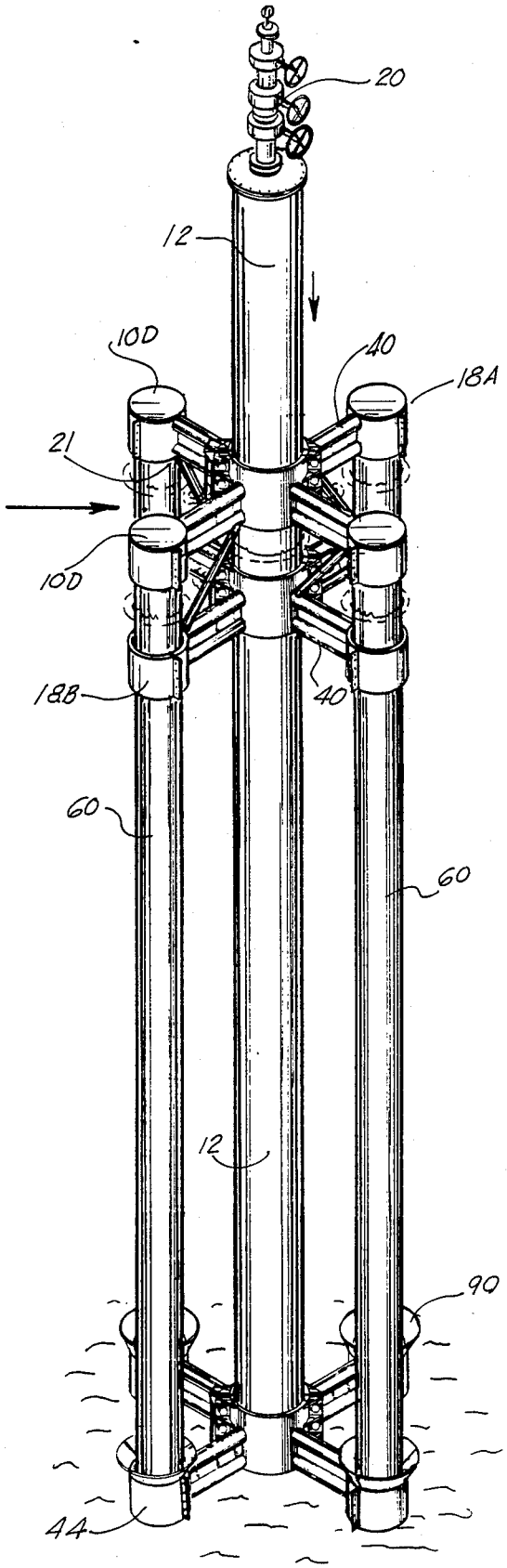
FIG. 8 illustrates the erected conductor and/or caisson support system of the present invention.

The system of the present invention is illustrated in the Figures, with a completed system in the preferred embodiment illustrated in FIG. 8. However, pertinent to the system of the present invention is a method of assembly, which will be discussed as seen in FIGS. 1–4. As illustrated in the Figures, FIG. 1 illustrate a caisson 12 which has been mounted into the sea bed 14 as illustrated in phantom view as 13. Caisson 12 would extend up vertically up to the water line 16 of the body of water 15, with the caisson 12 extending upward a distance to its upper end point 18 wherein a well head or "Christmas Tree" 20 would be secured and would be operational to serve in the transport of product from the body water onto land, or be serviced by boats or the like. The well head caisson 12 would incorporate an interior line for carrying product up to the well head where it could then be diverted to distance points. Due to the wave action in the lateral forces of the body of water 15 on the vertical caisson 12, there is a need to support the caisson 12 so that it is not damaged or destroyed by the lateral forces caused by the wave action.

Figure 2:
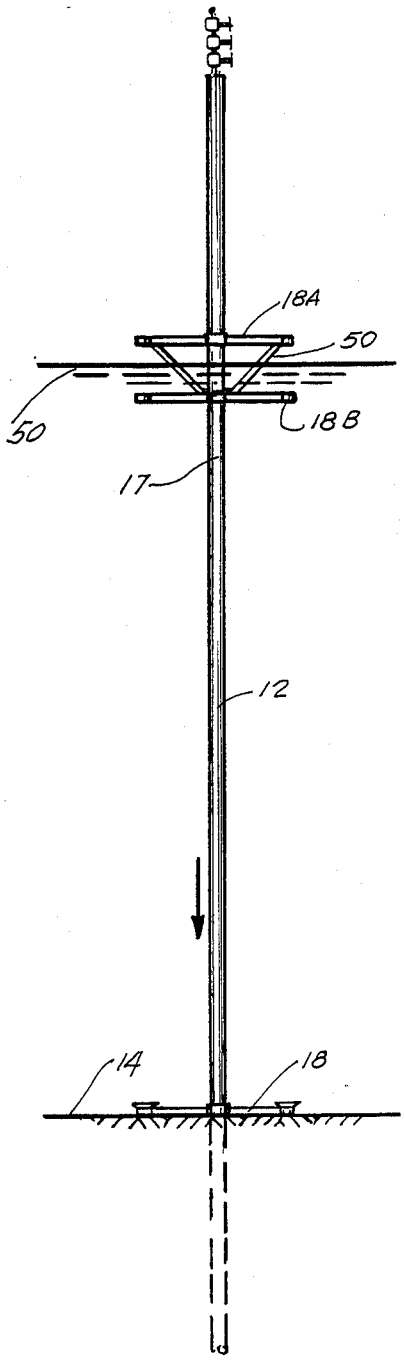
FIGS. 2–4 illustrate the method of erection of the conductor and/or caisson support of the present invention.
Figure 3:
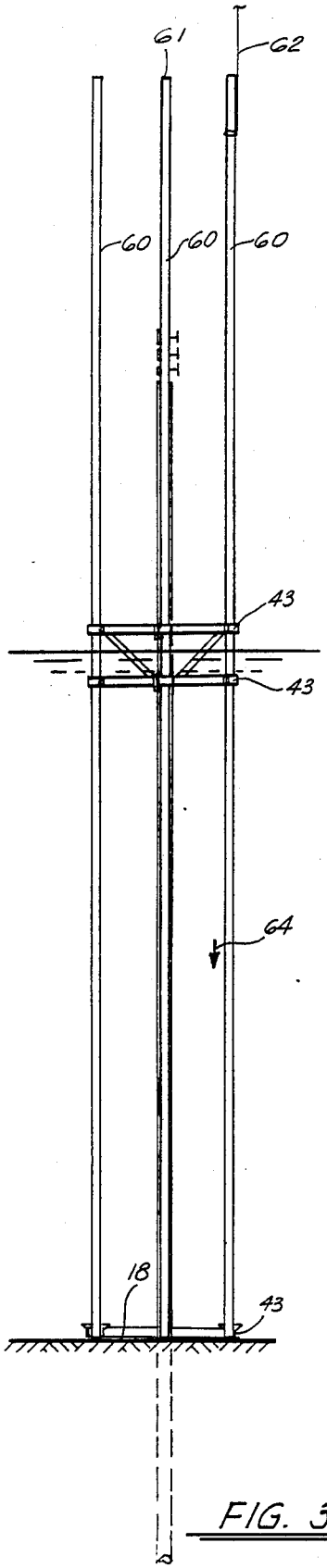
Figure 4:
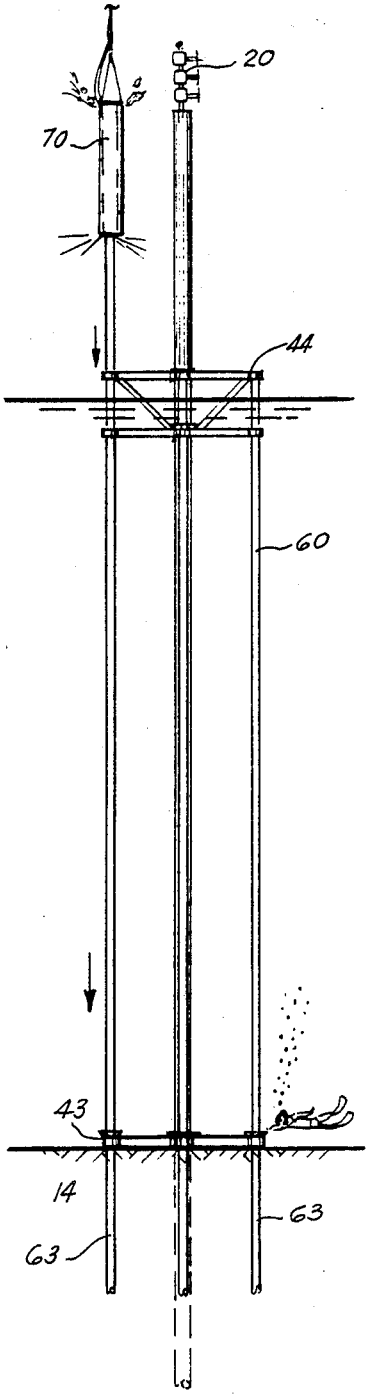
Figure 5:
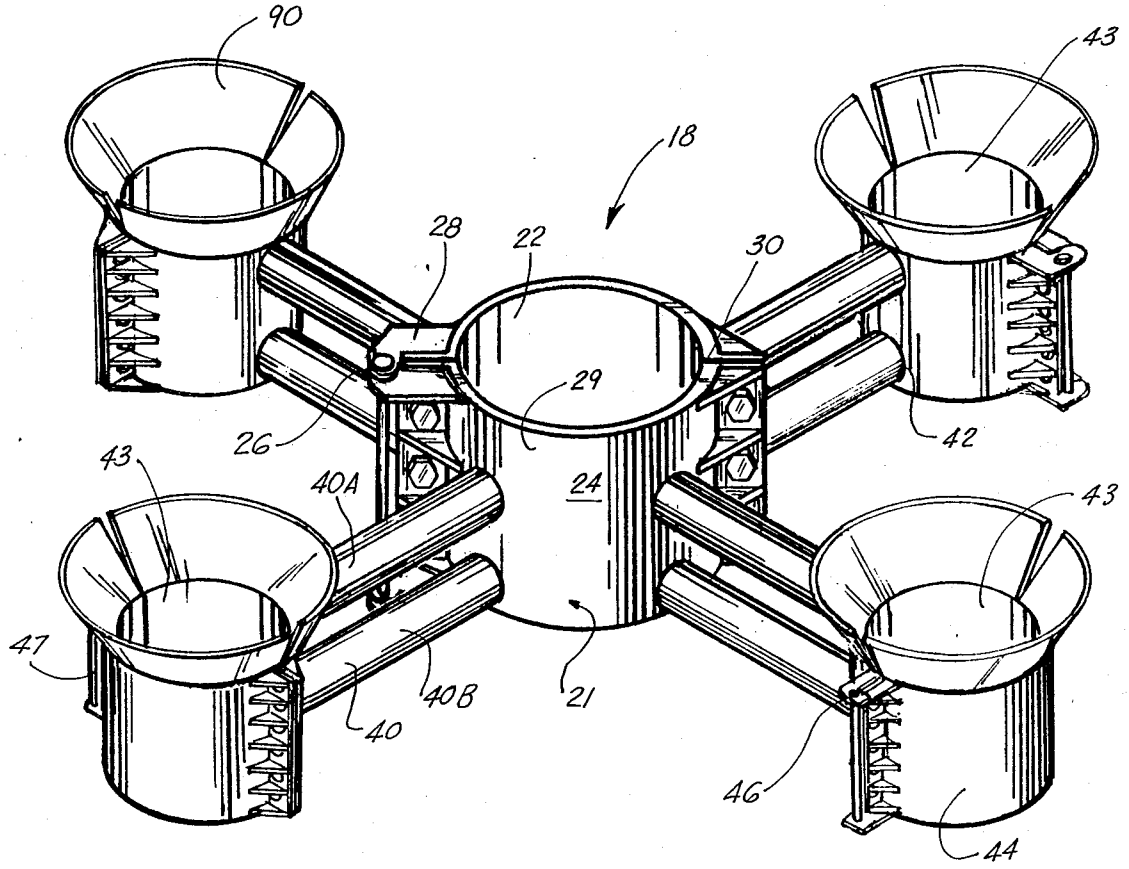
FIG. 5 illustrates in perspective view the support clamp system utilized in the conductor and/or caisson support system of the present invention.

In the system of the present invention would be installed to prevent such an occurrence. As illustrated in FIGS. 2–4, the system would incorporate a clamping means which would be engaged around the circumferential annular wall 17 of the caisson, of the type of clamping means as is illustrated in FIG. 5. Turning now to FIG. 5, clamping means 18 would comprise a central circular clamp 21 comprising semi-circular half portions 22 and 24 which would be hingedly engaged at pin member 26, via upper and lower brackets 28 along the wall 29 of each half portion 22, 24, so that half portions 22, 24 may be opened on their opposite end 30, so that clamp 21 may be fitted around the wall 17 of caisson 12 as illustrated in FIG. 2. Following the positioning of central circular clamp 21 around the wall 17 of caisson 12, a plurality of bolts 32 would be secured onto plate members 34 so that the clamp 20 is fixedly engaged around caisson 17.

As illustrated further, each central clamp 21 would include radiating arm members 40, each of the arm members 40 radiating outwardly at ninety degree intervals from the outer wall 29 of clamp 21, with each of the radiating arm members radiating as an upper arm member 40A and a lower arm member 40B which would be secured to the wall 29 of clamp 21 via welding or the like. At the farthest most end point 42 of each arm member there is included a piling clamp 44 so that each pair of arm members 40A, 40B would be secured onto a piling clamp 44 which would have a similar construction as central clamp 21 i.e., an end portion having a hinge member 46 on one end and on the opposite end a means 47 for securing the clamp in the closed position around each of the pilings positioned within central opening 43 that would be utilized with the system through bolting as with central clamp 21.

This discussion of the clamp members that would be utilized in the present invention will be pertinent to each of the clamp members utilized in the system, and would be discussed further in the context of the method of installing the system for securing caisson 12 in position.

Returning to FIG. 2, in the construction of the system, a first clamp member 18 of the type is illustrated in FIG. 5 has been positioned on the sea bed 14 around caisson 12 in the manner as was previously discussed. Prior to the tightening of bolts 32 around the wall 17 of caisson 12, clamp member 18 would be secured around the wall 17 of the caisson in a substantially loose configuration and would allowed to slide down the caisson and be resting on the sea bed 14 as illustrated in FIG. 2. Following the positioning of the clamp member 18 onto the sea bed 14, center clamp portion would then be tightenly engaged around the wall 17 of caisson 12, and would in position for accepting the pilings as will be discussed further. Subsequent to the final positioning of initial clamp member 18, there would be also provided a second composite clamp member 18 which would comprise a first upper clamp member 18A and a second lower clamp member 18B. Clamp members 18A and 18B secured together via truss members 50 to form composite clamp 18 as seen in FIG. 2. In the positioning of clamp member 18A and 18B, lower clamp member 18B would be secured below the water line, and upper clamp member 18A would be secured above the water line as illustrated in the Figure.

Following the positioning of composite member 18, central clamp portion 20 would then be secured around the wall 17 of caisson 12, and would be secured in place. It should be noted that the openings 43 through the various piling clamps 44 would be aligned with the openings 43 of the base clamp 18 that is resting on the floor of the sea bed to receive the piling members that are driven vertically down thereinto (FIG. 3).

Turning now to that step of the process, reference is made to FIG. 3, wherein piling 60 is hung via a line 62 and is slidingly positioned through the openings 43 and upper and lower clamp members 18A and 18B respectively, (composite clamp 18). Following the maneuvering of piling 60 therethrough, piling 60 is then slid down in the direction of arrows 64 where it is then received into opening 43 of base clamp 18 as illustrated. Following that step, each piling 60 is in turn positioned in a similar manner through the respective piling clamps 44 as illustrated in FIG. 3. Reference is now made to FIG. 4 where a pile driver apparatus 70 would then in turn hammer the lower end 63 each of the pilings down into the sea bed 14, until such time as the upper end 61 of each piling would be flush with the upper portion of each of the clamp members 44 as illustrated in FIG. 4.

Following the driving of each of the pilings flush with the top of the upper clamp member 18A is illustrated, each of the piling clamps 44 are then boltingly engaged and secured around each of the pilings 60 and the structure is therefore securely in place with the lower portion 63 of each of the pilings being driven a distance downward into the sea bed 14 so as to form a secure a base around the caisson. For purposes of structural integrity, the four pilings spaced equal distance around the center caisson via the clamp members as seen in FIG. 8, provides a secure vertical support that can withstand the most vigorous wave action during storms or the like, and yet would not interfere with any activity that might want to take place on the well head or "Christmas tree" 20 during operations. As is noted, due to the fact that the four pilings are secured via radial arm members 40 extending therefrom, the caisson 12 is accessible over 360° by boat or the like, and therefore would provide a greater accessibility to the caisson to the caisson than is presently found in the art.

Figure 6A:
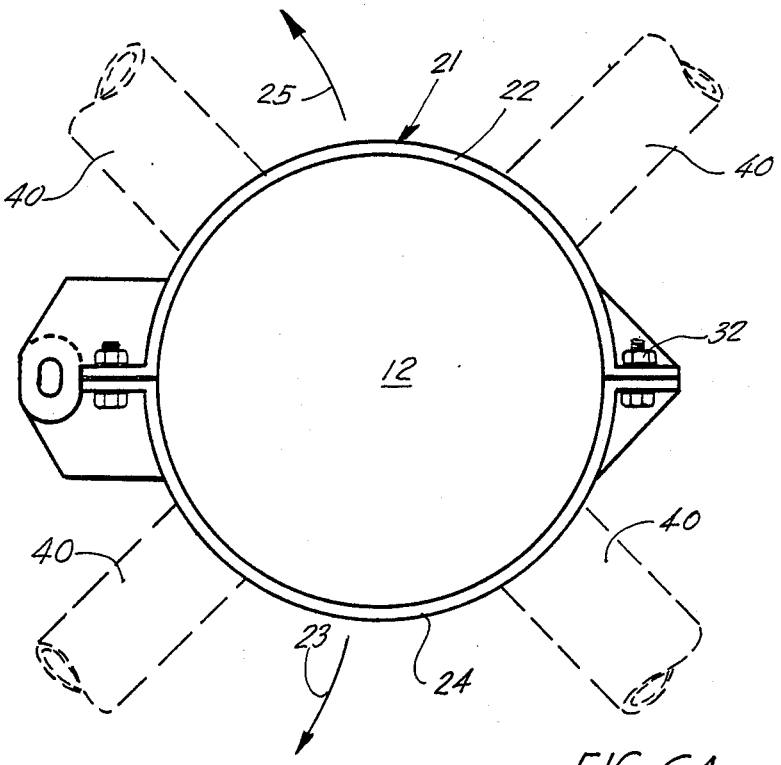
FIGS. 6A and 6B illustrate top and side views respectively of the conductor and/or caisson support clamp utilizing the system of the present invention.
Figure 6B:
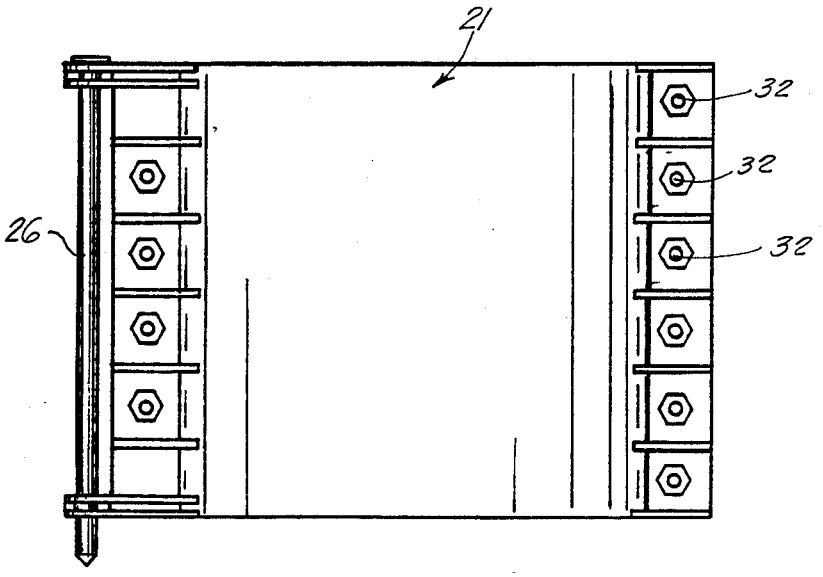

FIGS. 6A and 6B illustrate in detail the center of clamp member 21 that was discussed heretofore. There is illustrated in top view in FIG. 6A each of the half portions 22 and 24 respectively, which each half portion movable in the direction of arrows 23 and 25, so that each of the half portions 22 and 24 may open up so that clamp 21 may be allowed to slip around caisson 12 while in the open position. In FIG. 6A the clamp member is shown in the closed position and held fast in place via bolts 32 as was discussed earlier. There is further illustrated in 6A in phantom view the four pairs of arms 40 radiating outwardly from the clamp which would secure at the farthest most end, each of the piling clamps 44 as was discussed further. As illustrated in side view in FIG. 6B the clamp would be secured throughout its length via a series of bolts 32 as illustrated so that clamp 21 is secured throughout its length around the wall of caisson 12 during operation. FIG. 6B further illustrates clearly the pin member 26 which serves the hinging function of the clamp prior to engagement via bolts 32.

Figure 7D:
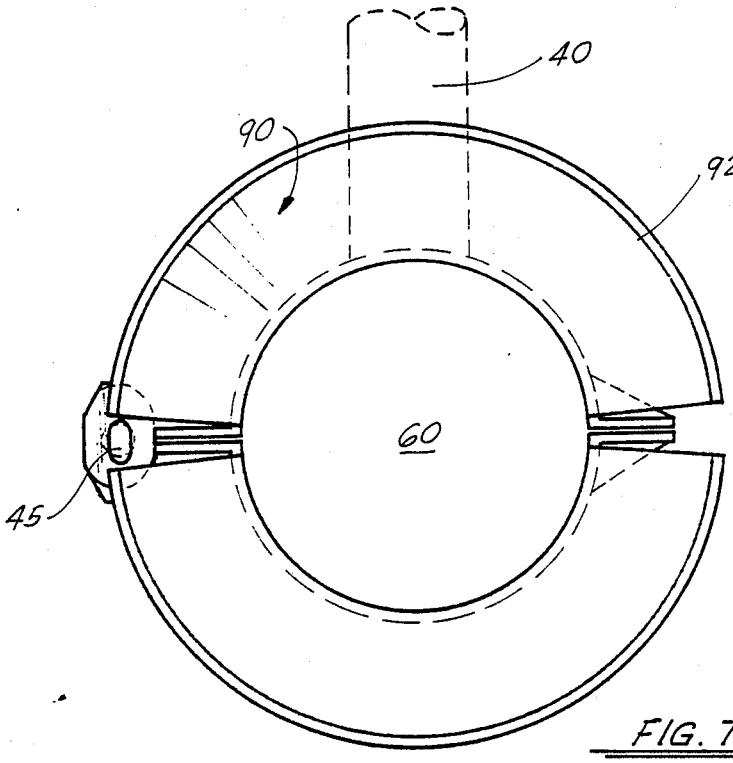

Turning now to FIGS. 7A–7E, there is illustrated in various views each of the piling clamp members 44 as was discussed. As illustrated again, each clamp member 44 would comprise semi-circular half portions 41 and 43 respectively, with each of the half portions hingedly engaged via a pin 45 along their length, which again allows each of the half portions to swing in the open position as with central clamp member 21. As with central clamp member 20 each of the piling clamp members would likewise include metal brackets 47 for again boltingly securing each of the half portions 41, 43 in place around each of the pilings 60 via the series of bolts 32 as illustrated in FIG. 7B. As further illustrated, in order to firmly secure each of the clamps 44 onto the piling 60, there is provided a plurality of cutout portions 80 along the upper wall of each of the clamp semi-circular half portions 41, 43, so that as piling 60 is inserted thereinto, and clamp member 44 is securely engaged via bolt 32, members 41, 43 may be welded in place along the edge of cutouts 80 so as to more thoroughly engage each of the clamps 44 around the wall 17 of each piling 60. As illustrated in FIG. 7C, the pin member 45 is secured within a slot 49 through each of the plate member extending out from the wall of each of the clamps 44 so that as the clamp halves 41, 43 are opened, there may be allowed sliding movement between the members 41, 43 for ease of opening.

Figure 7E:
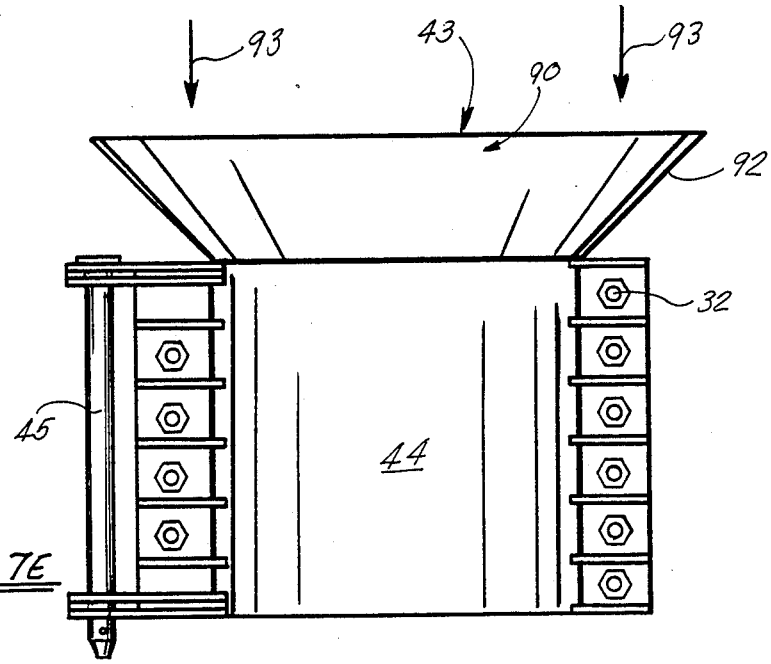

FIGS. 7D and 7E illustrate in top and side view respectively a cone member 90 which is positioned through welding along the upper edge of each of the clamps 44, with cone member 90 having a sloping annular wall 92, extending upward from the edge of clamp member 44, so that as each of the pilings 60 are moved downward in the direction of arrows 93 toward each clamp 44, the cone member 90 serves as a guide for the end of the piling to be properly positioned within the space 43 of each of the clamps 44 again to ease in the erection of the system.

In the erected system, as illustrated in FIG. 8, the upper portion each of the clamp members 18A would be, in the preferred embodiment, capped off with a cap member 100 if the system were erected as illustrated in the Figure. Therefore, as was stated earlier, access would be had through all sides of the caisson 12 to well head 20 through any direction, due to the complete vertical erection of the system as illustrated in FIG. 8.

Figure 9A:
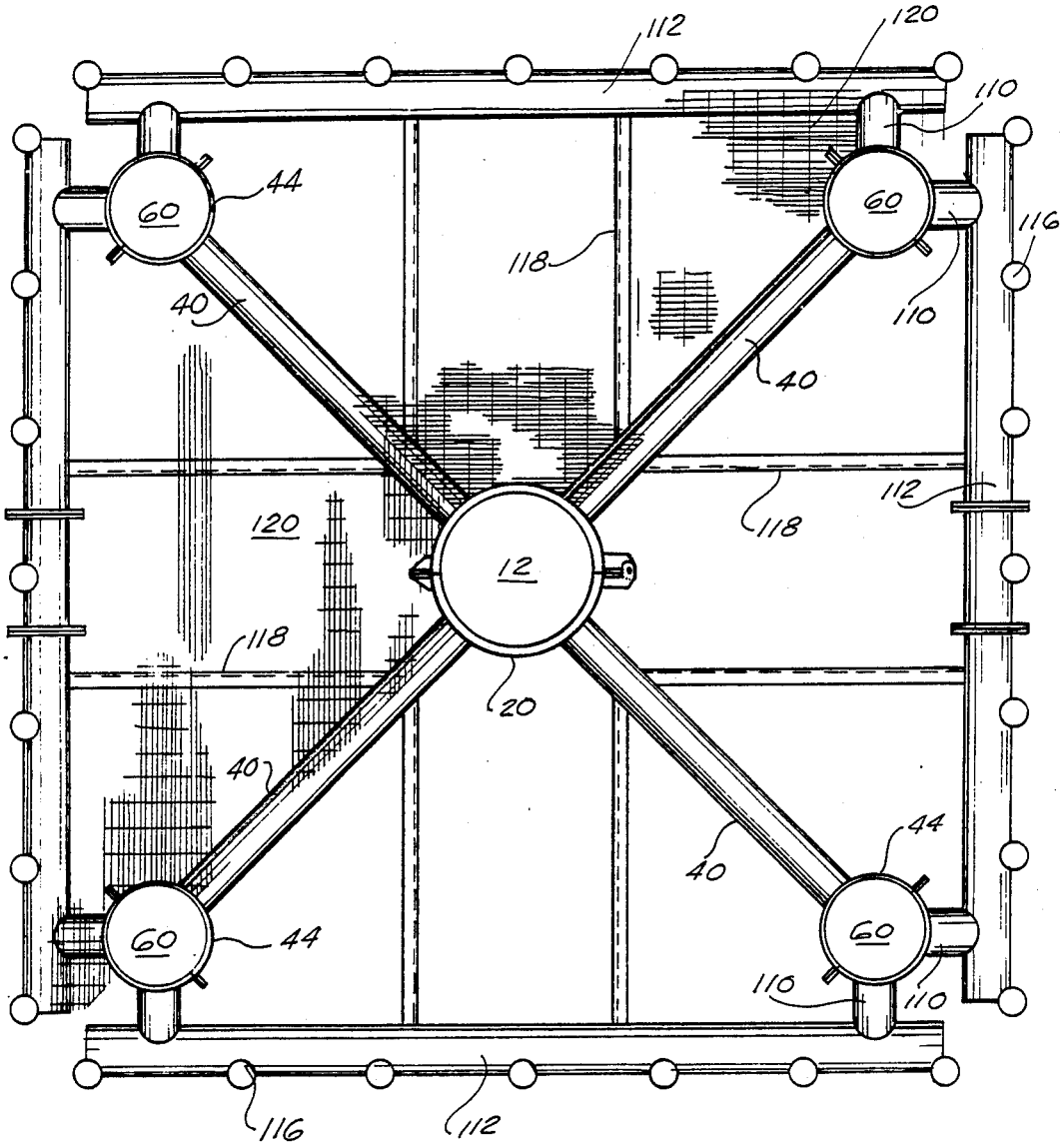
FIGS. 9A and 9B represent top and side views respectively of the erected boat landing utilized with the system of the present invention.
Figure 9B:
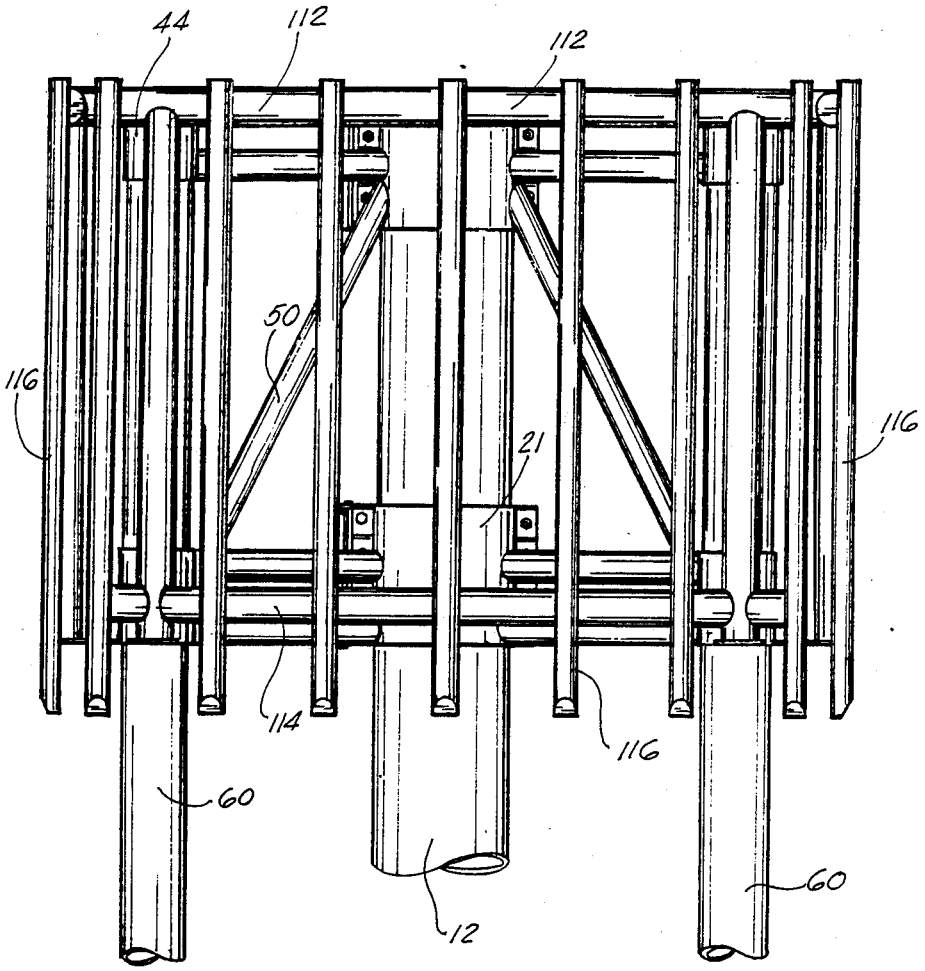

However, to facilitate further use in access to the system, there may be provided in most cases a boat deck positioned upon the plurality of pilings 60, with the boat deck construction illustrated in FIGS. 9A–9B. As illustrated, particularly in top view 9A, there is illustrated central clamp member 21 with the four series of radiating arms 40 radiating outwardly therefrom and connectedly engaged to piling clamps 44. Of course each of the clamps 44 would house a piling 60, and central clamp 21 would house caisson 12.

In the event one would want to construct a boat landing or a boat deck, the construction would require initially the removal of the cone guide 90 from each of the clamp members 44. Thereafter, each of the clamp members 44 would be provided with a pair of arms 110 extending outwardly therefrom as seen in FIG. 9A with each of the pair of clamps supporting a horizontally disposed cross-member 112 through welding or the like, along clamp 18A, and an identical parallel cross-beam 114 positioned between each of the clamps 44 as illustrated in FIG. 9B. Therefore, a series of four parallel beams 112 and 114 would be positioned around the four clamp members 44 in the fashion as seen in FIG. 9A, with likewise a parallel pair of beams 114 as illustrated in FIG. 9B, to define the outer framework of the boat landing. Following the positioning of the horizontal beam members 112 and 114, a plurality of vertically disposed interconnecting beams 116 would be provided, spaced apart along the length of each of the beam members 112, 114 as illustrated in 9A and 9B, to define both a support system for the metal deck of the boat deck, and as a bumper system against the inadvertent movement of boats into the piling system as illustrated in FIG. 9B.

There may then be further provided a plurality of support beams 118 interconnecting the horizontal beams 112 and the radiating arm members 40, so as to further strengthen the support system for the boat deck. Following the positioning of the beam construction as illustrated in FIG. 9A, a metal decking 120 would be placed upon the top of the beam system as illustrated in FIG. 9A to provide the deck surrounding the caisson 12 as illustrated. It should be made clear that due to the unique construction of the support system for the caisson, that all of the support for the deck and any machinery or the like which would be positioned onto the decking 120 would be supported solely by the plurality or four pilings 60 as illustrated, and none of the support would rely on the strength of the caisson. In this manner, therefore, the caisson is not serving as a support means, which may create a dangerous situation, but is simply erected to support the "Christmas tree", and all vertical stress is being imparted to the pilings 60 as seen in the Figures.

Figure 10:
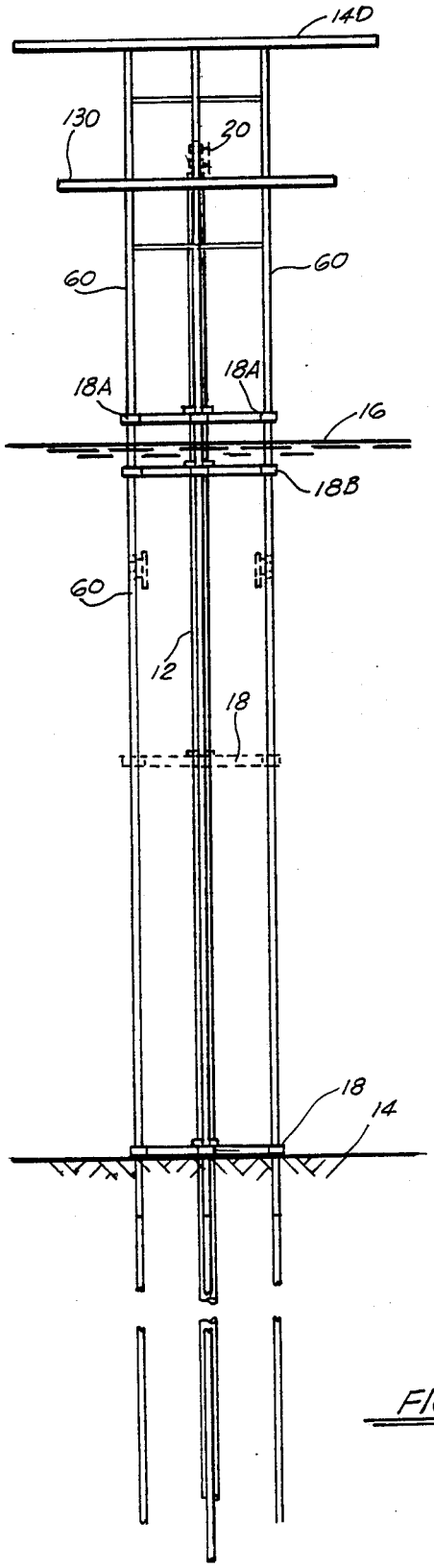
FIG. 10 represents an alternative embodiment of the system of the present invention illustrating erection above the well head utilizing the system of the present invention.

FIG. 10 illustrates an additional embodiment or improvement on the present system which is not found in the art. In FIG. 10 there is illustrated the basic support system again which would comprise a central caisson 12 with a series of pilings 60 supported by the base clamp 18 and the upper clamps 18A and 18B. As further illustrated in FIG. 10, the basic system may include an intermediate clamp 18 which would be positioned between the water line 16 and the sea bed 14, in the event that the water was of such a depth that would require an intermediate clamp secured thereinto. Further is illustrated rising above clamp 18 would be as further illustrated, FIG. 10 would include a second layer of pilings 60 extending upward from upper clamp 18A and secured thereto in a similar fashion as would lower pilings 60, to provide an upper deck 130 at the level for example of the "Christmas tree" 20, so that direct access may be had to the "Christmas tree" 20 by the workmen on upper deck 130. For purposes of construction, upper deck 130 may be made in a similar manner as the boat deck 120, but since it would not be positioned at the water level, would not require a bumper system that is illustrated in FIG. 9B but would only require a decking 120 since decking 120 would be supported by upper piling 60 in construction. As further illustrating if in fact one wanted to construct for example a heliport deck 140, the pilings may be extended to an even greater height as illustrated in FIG. 10, so that the upper heliport deck 140 could be constructed in a similar manner. It is important to note that the construction of a series of decks as illustrated in FIG. 10 is possible with the present system in view of the fact that the plurality of pilings 60 that are driven into the sea bed 14 and extend vertically upward may support this multiple configuration decks due to the fact that the total support of this system is taken in through the vertical forces into the pilings and into the sea bed, and none of the force is required to rely upon the strength of the caisson 12. It is therefore possible to construct this system in an easy and straightforward manner, and would provide for the multiple decking system as illustrated in FIG. 10.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A well head caisson of the type extending from the sea bed to a point above the level of the water, the system comprising:

(a) first clamp means secured around the caisson and substantially resting on the floor of the sea bed;

(b) second clamp means secured around the caisson substantially at the water level;

(c) means provided on the first and second clamp means, for receiving a plurality of vertically aligned pilings spaced around the caisson, each of the pilings aligned and secured through the receiving means on the first and second clamp means, for driving into the sea bed;

(d) means for maintaining the pilings in vertical parallel relationship with the alignment of the caisson; and (e) means for aligning the receiving means of the first clamp means with the receiving means of the second clamp means so that the pilings are maintained in vertical relationship after being secured thereto;

(f) a means for providing that any forces placed upon the system would be undertaken by the plurality of pilings, downward into the sea bed and would not result in vertical forces acting on the caisson.

2. The system in claim 1, wherein each of the first and second clamp means provides four equally spaced receiving means for the pilings to be received therethrough.

3. The system in claim 1, wherein the first and second clamp means are secured around the caisson through first and second semi-circular half portions hingedly moved from a first open position to a second closed position around the wall of the caisson.

4. The system in claim 1, wherein the receiving means attached to the first and second clamp means further included first and second semi-circular half portions hingedly engaged for moving between a first open position to a first closed position around the wall of each of the piling members.

5. The system in claim 1, wherein the second clamp means secured around the caisson at the water level, may further include first and second clamp members, wherein a first member is positioned above the water level, and the second member is positioned below the water level, with the first and second members secured to one another through strut members.

6. The system in claim 1, wherein the system may further include a boat deck secured adjacent the caisson and positioned and supported solely by the plurality of pilings spaced apart around the caisson.

7. The system in claim 1, wherein there may be further included an additional clamp means intermediate the first clamp means resting on the floor of the sea bed and the second clamp means substantially at the water level.

8. The system in claim 1, wherein each of the piling members secured around the caisson out of the uppermost end point substantially at the level of the head of the caisson.

9. The system in claim 1, further comprising means for extending the plurality of piling members above the caisson for supporting an additional deck or the like atop the extending piling members.

10. A system for supporting a well head caisson in the vertical upright position, the well head caisson of the type extending from the sea bed upward through the water line, and having a production system at its upper end, the support system comprising:

(a) a first clamp member, secured around the wall of the caisson, and including a plurality of radiating arms therefrom, each of the arms including a piling clamp at its farthest most end;

(b) a second clamp member, secured around the wall of the caisson, at substantially the level of the water line, and likewise having a plurality of equally spaced radiating arms, each of the radiating arms providing a piling clamp at their farthest most ends;

(c) means for aligning the piling clamp of the first clamp means with the piling clamps of the second clamp means in vertical relationship;

(d) a plurality of pilings, each of the pilings insertable through a piling clamp in the upper clamp means and a vertically aligned piling clamp in the second clamp means, so that each of the plurality of pilings are in vertical parallel relationship with the caisson;

(e) means for engaging and securing the lowermost end of the plurality of pilings into the sea bed; and (f) a means for providing that any forces placed upon the system would be undertaken by the plurality of pilings, downward into the sea bed and would not result in vertical forces acting on the caisson.

11. A method of constructing a well head caisson support system, for supporting a caisson of the type extending upwardly from the sea bed to above the water line, the method comprising the following steps:

(a) providing a first caisson clamp means, slideably engaged around the caisson, and including a plurality of piling clamps extending outwardly therefrom;

(b) positioning the first clamp means securely around the caisson and resting on the sea bed floor;

(c) providing at least a second clamp means secured around the wall of the caisson, the second clamp means likewise including a plurality of piling clamp members extending radially therefrom, and the clamp means secured around the wall of the caisson substantially at the water level;

(d) aligning each of the piling clamp members of the lower clamp means with the piling member of the upper clamp means;

(e) lowering a piling into a piling clamp of the upper clamp means and sliding the piling downward so that the lower end of the piling is slid into a corresponding piling clamp on the lower clamp means on the sea bed;

(f) driving the piling downward into the sea bed to a point so that the upper end of the piling is substantially flush with the upper edge of the upper piling clamp;

(g) repeating step "d" for each of the respective piling clamps radiating outwardly from the upper clamp means; and (h) tightening the piling clamps around the wall of the pilings so that the pilings are securely in place around the upper and lower clamp means to provide a vertical system for the well head caisson.

12. The method in claim 11, further comprising the step of adding a third upper clamp means around the caisson substantially at the level of the well head, the third clamp likewise having a plurality of piling clamps radiating outwardly therefrom.

13. The method of claim 11, further comprising the step of aligning the piling clamps of the third clamp means with the piling with the second clamp means.

14. The method of claim 11, further comprising the step of slidingly positioning a piling through each of the clamp members of the third clamp means, so that each of the pilings are engaged into the second clamp means second to piling members.

15. The method of claim 11, further comprising the step of constructing a boat deck or the like atop the upper portion of the piling of the third clamp means so as to provide a construction deck to work therefrom.

16. The method of claim 11, further comprising the step of adding additional pilings atop the four exiting piling, for constructing a deck or the like above the caisson well head, for use as a landing pad or work area.

* * * * *